United States Patent [19]

Kastenhuber et al.

[11] Patent Number: 4,600,167

[45] Date of Patent: Jul. 15, 1986

[54] PIVOTING GUIDANCE MECHANISM FOR SMALL-CALIBERED PROJECTILES

[75] Inventors: Manfred Kastenhuber, Rednitzhembach; Alfred Eckel, Ireuchtlingen; Erich Bock, Nuremberg, all of Fed. Rep. of Germany

[73] Assignee: Diehl GmbH & Co., Nuremberg, Fed. Rep. of Germany

[21] Appl. No.: 634,302

[22] Filed: Jul. 25, 1984

[30] Foreign Application Priority Data

Aug. 6, 1983 [DE] Fed. Rep. of Germany ..... 3328520

[51] Int. Cl.[4] ..... F42B 13/32

[52] U.S. Cl. ..... 244/3.28; 244/326; 102/385

[58] Field of Search ..... 244/3.27, 3.28, 3.26, 244/49, 218; 102/385, 388

[56] References Cited

U.S. PATENT DOCUMENTS 3,819,132 6/1974 Rusbach ..... 244/3.28

3,921,937 11/1975 Voss et al. ..... 244/3.28

*Primary Examiner*—Deborah L. Kyle

*Assistant Examiner*—Michael J. Carone

*Attorney, Agent, or Firm*—Scully, Scott, Murphy & Presser

[57] ABSTRACT

A pivoting guidance mechanism for small-calibered projectiles, missiles or small bombs with fins, which are form-fittingly fixed and axially oriented within a housing, are pivotable transverse to the longitudinal axis and guided in longitudinal slots in the housing, and which include a slider for extending the fins which is actuatable through a pretensioned, central coil spring.

6 Claims, 4 Drawing Figures

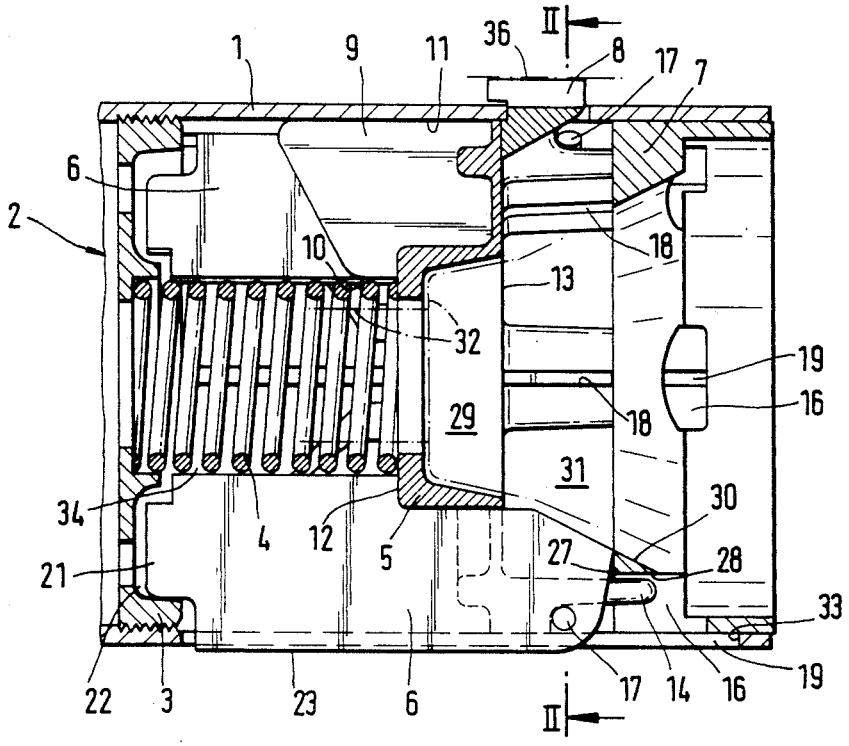
FIG. 1
FIG. 2
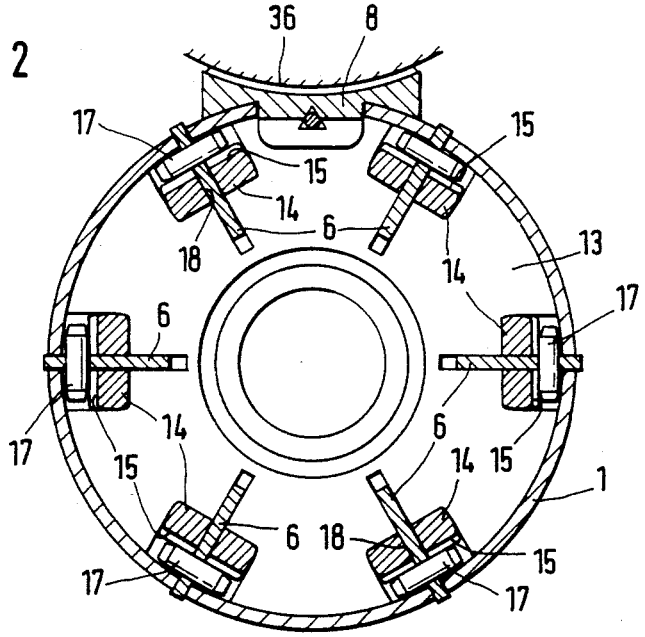

PIVOTING GUIDANCE MECHANISM FOR SMALL-CALIBERED PROJECTILES

BACKGROUND OF THE INVENTION

1. Field of the Invention

The present invention relates to a pivoting guidance mechanism for small-calibered projectiles, missiles or small bombs with fins which are form-fittingly fixed and axially oriented within a housing, are pivotable transverse to the longitudinal axis and guided in longitudinal slots in the housing, and including a slider for extending the fins which is actuatable through a pretensioned, central coil spring.

2. Discussion of the Prior Art

From the disclosure of German Laid-open Patent Application No. 21 37 766 there has become known a fin arrangement for a projectile for a bazooka or shoulder-fired rocket launcher, in particular for training purposes, in which the fins pivot radially outwardly from the projectile. The fins and a spring-actuated slider sleeve are constructed as cam drives, in which the pivoting of the fins is effected in a direction opposite to that of the direction of flight. As a consequence thereof, the constructional length of the entire fin arrangement is relatively large.

From the disclosure of German Published Patent Application No. 12 31 139 there has become known a projectile with a rocket propulsion device. The projectile incorporates a plurality of separately brakeable payload warheads. Provided for this purpose are a large number of cup-shaped or dished fins which are pivotable opposite to the fall direction.

From the disclosure of German Patent No. 22 27 104 there has become known a projectile with an extendable guidance mechanism, whose fins can be extended outwardly tangentially relative to the support for the guidance mechanism. The fins are fixed in their retracted position through a gas pressure-dependent, multi-component locking arrangement. At a predetermined gas pressure, the fins are extended outwardly responsive to the gas pressure and/or a pressure spring through the intermediary of a slider sleeve. As is known, with multi-component arrangements the probability of failure is higher than for single-component arrangements. Moreover, there is no indication in this publication as to the manner in which the fins can be latched in their outwardly extended position so as to be able to eliminate any possible disruptive sources, such as turbulences in the air.

SUMMARY OF THE INVENTION

Accordingly, it is an object of the present invention to so construct a pivoting guidance mechanism as described hereinabove, which will exhibit the smallest possible dimensions, and which is constructed extremely lightweight so as to achieve a high packing density for the projectile, and which, for optimizing the payload component in the projectiles, consists of few relatively simple components and for this purpose possesses precisely guided fins which, through a limited degree of extendability beyond the latching device, will reduce any shocks and impacts caused by air turbulences.

The foregoing object is achieved through an inventive arrangement of the above-mentioned type in that the fins will in the retracted inoperative position thereof radially bound the storage space for the coil spring and their free ends will be located in approximately the same plane as the end of the coil spring towards the housing; in that the slider will, through an axial stroke thereof, unlatch the form-fitted locking of the fins in the retracted position, which fins are rotatably supported on the slider and are radially outwardly extendable opposite the direction of flight due to tangentially arranged supports extending transversely of the longitudinal projectile axis and in an end position are lockable through a cam drive mechanism formed by the slider, the ends of the fins towards the supports, and an axially movable bearing ring, and with a bearing point being located radially below the support.

The principle of construction is based on a spring load-actuated cam drive mechanism, whose characteristics are based in that subsequent to the unlatching of the fins, the latter are pivoted outwardly at a relatively high angular acceleration from their inoperative position whereby, during the course of the pivoting movement, the acceleration will continuously decrease up to the point in movement at which the pivoting motion extends into a gliding motion. This gliding motion then leads to the latching of the fins in their end position.

In accordance with a particular feature of the invention, there is provided a simple cam drive mechanism which is found through minor constructive modifications of elements which are already present for a pivoting guidance mechanism. Thereby, the bearing point of the bearing ring which is located below the rotational axis of the fins will facilitate that, at an axial pressure of the slider, the roll track can roll off over this bearing point and afford an easy outward pivoting of the fins.

The two-stepped roll cam track at the bearing ring, during the first step, effects the actual outward pivoting motion of the fins, and during the second step the form-fitted or immovable latching of the fins in their end position.

In accordance with a further feature of the invention there is provided a simple measure for the locking of the fins in their retracted position; whereas, pursuant to another feature of the invention, there is provided a constructively simple and inexpensive support of the fins on the slider. In addition, the invention also provides for a simple securing against rotation by the slider so that the outwardly pivoted extended fins are restrained with regard to the direction of rotation.

BRIEF DESCRIPTION OF THE DRAWINGS

Reference may now be had to the following detailed description of an exemplary embodiment of the invention, taken in conjunction with the accompanying drawings; in which:

FIG. 1 illustrates a longitudinal sectional view through the pivoting guide mechanism for a small bomb;

FIG. 2 is a sectional view taken along line II—II in FIG. 1;

DETAILED DESCRIPTION

Figure 3:
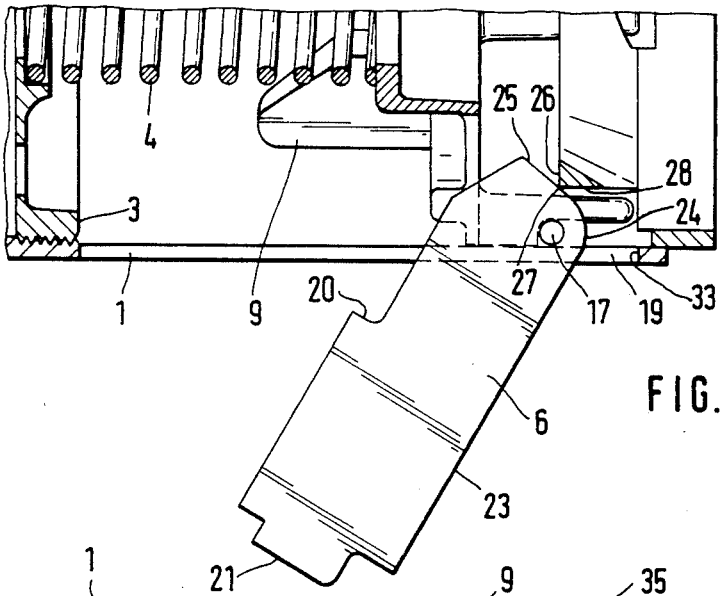
FIG. 3 illustrates a fragmentary portion of the pivoting guidance mechanism, partly in section, during a phase of movement within the pivoting sequence.
Figure 4:
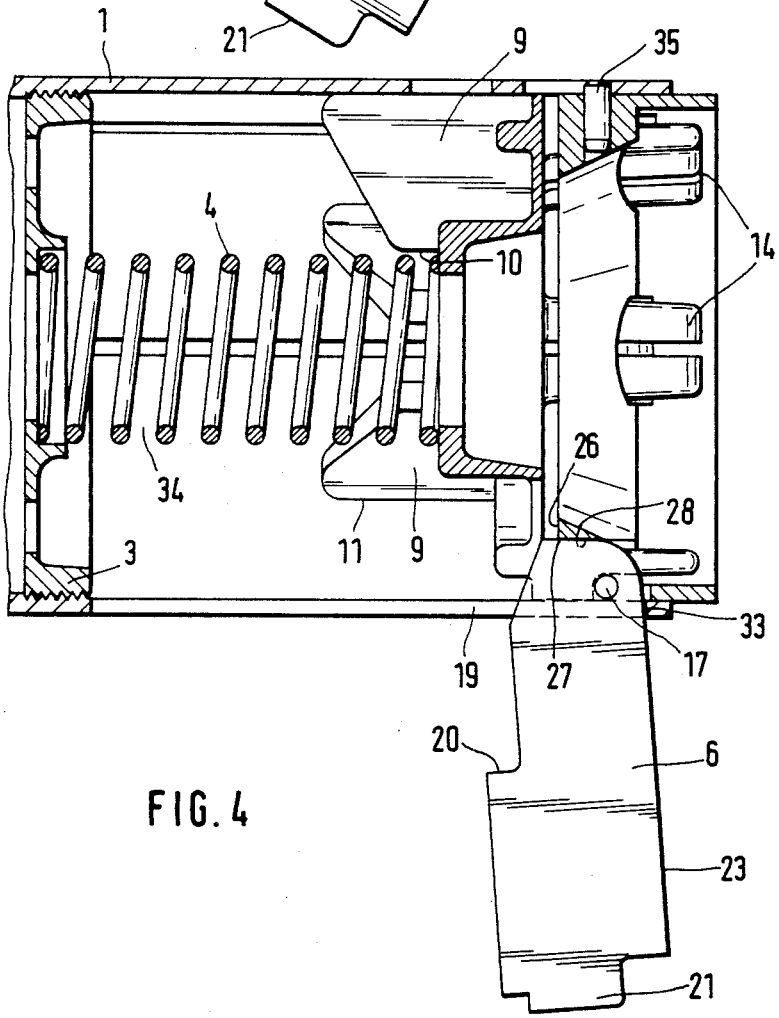
FIG. 4 illustrates a sectional view of the pivoting guidance mechanism in the locked extended end position thereof.

In accordance with FIGS. 1 and 2 of the drawings, within the casing 1 of a small bomb 2 (not shown in detail) there is arranged a support ring 3 fixed in the casing, a coil spring 4 centrally supported in the support ring 3, a slider 5, fins 6, an axially movable bearing ring 7, and a releasable latch 8.

The coil spring 4 supports itself centrally against the support ring 3 and in turn, again centrally, acts against the slider 5 which, on its end surface 12 facing towards the coil spring 4, incorporates radially directed arms 9. The inwardly located surfaces 10 of the arms 9 centeringly encompass the coil spring 4, whereas the radially outwardly located surfaces 11 of the arms 9 contact against the inner wall of the casing 1 in an axially guiding mode.

The essentially annular or ring-shaped slider 5 is provided, at its end surface 13 facing away from the arms 9, with axially directed tongues 14 which are uniformly distributed about the circumference and which presently each contact intermediate two neighboring arms 9. The tongues 14 are each divided through a slot 18 extending in parallel with the longitudinal center axis, and which extends radially up to the ring-shaped body of the slider 5. At their outer circumference, the tongues 14 are further provided with tangential bearing shoulders 15 which are formed to extend transversely of the longitudinal axis of the casing 1. The bearing ring 7, which is secured against rotation but is axially movable, includes apertures 16 for receiving of the tongues 14. Due to the tongues 14 which engage into the apertures 16, as well as due to the fins 6 which are movable within the elongated slots 19 in the casing 1, the slider 5 is positioned so as to be secured against rotation. The bearing ring 7 is secured against rotation through the intermediary of radial pins 35, which engage into the longitudinal slots 19 in the casing 1, and upon contacting against the axial limit of the elongated slots 19 stop the axial movement of the stop ring 7.

The fins 6 each incorporate at one end thereof a coiled clamping pin 17 which is inserted into a throughbore, which serves as the bearing and rotational axis for the fins and which lies against the bearing shoulder 15. By means of the inner wall of the casing 1, the bearing position of the bearing shoulder 15 is restricted radially outwardly. In their retracted inoperative position, the fins 6 are located within the radial slot 18 of the slider 5, and thereby lie with one surface 20 thereof against the axial end surface 12 of the slider 5, whereby the fins 6 are secured against any axial displacement. Through the projection 21 on the end surface edge opposite the coiled clamping pin 17, the fin 6 is located in an annular recess 22 of the support ring 3, and is thereby restrained against any radial outward pivoting during its inoperative period. The width of the fin 6 is so large that the fin 6 will also in its inoperative position be guided by the radially outwardly located edge 23 in the elongated slot 19 of the casing 1 and will easily extend outwardly beyond the external diameter of the casing 1.

The outer edge 23 of the fin 6, in the region of the coiled clamping pin 17, forms a transition into a cam roll track 24 which, in turn, ends at the end surface edge 25 of the fin 6.

With the lower portion of this end surface edge 25, the fin 6 axially stands on the end surface of the annular or ring-shaped surface 26 of the bearing ring 7. The bearing or rolloff point 27 on the bearing ring 7 hereby lies radially below the coiled clamping pin 17. The annular surface 26 extends through the rolloff point 27 at a right angle into the gliding track 28 of the aperture 16 in the bearing ring 7.

The slider 5 is constructed overall as a thin walled member. Through its central recess 29, which continues in the bearing ring 7 through an inner cone 30, it provides a further space 31 for the insertion at the heed end of a further small bomb 32 which is illustrated through phantom lines. The recess 29 in the slider 5 is hereby so configured as to form a supporting surface for the impact sensor of the subsequent small bomb 32 which due to its correlation with the surfaces of the recess 29, will remain undamaged during transport.

The function of the pivoting guidance mechanism is as follows:

When the outer restraint 36 for the latch 8 which, for instance, can be a cluster of bombs contacting with respect to the subsequent small bomb externally against the latch 8, is released or removed, then the latch 8 is ejected outwardly by the force of the coil spring 4 over the axially displaced slider 5. Consequently, the slider 5 will then axially slide within the sleeve 1 in the direction of the effective force of the coil spring 4. The slider 5 strikes, through the end surface edges 25 of the fins 6, axially against the bearing ring 7, which also wanders back a limited extent in an axial direction. With the continuing unstressing of the coil spring 4, the fins 6 then glide out of the recess 22 in the bearing ring 3, and are released from their radial restraint. The striking of the edges 25 of the fins 6 which are located below the coiled clamping pins 17 against the end surface 26 of the bearing ring 7 will then effect that the fins 6 will glide with their cam roll tracks 24 beyond the rolloff point 27, exert a rotational movement over the coiled clamping pin 17 and thereby will pivot radially outwardly with their free ends.

The pivotal movement of the fins 6 is caried out within the elongated slots 19 in the casing 1 up against their limiting edge 33. In this end region the cam roll track 24 lies on the glide path 28 with the connecting edge 25, after the slider 5 with its tongues 14 has moved into the corresponding apertures 16 in the bearing ring 7. The fins 6 are hereby secured in this position against any return pivoting due to their support on the gliding track 28 as well as due to the force of the coil spring 4.

What is claimed is:

1. A pivoting guidance mechanism for small-calibered projectiles, missiles or small bombs, including a housing having elongated slots; axially oriented and form-fitted fins being fastened within said housing, said fins having free ends and retained ends being pivotable transverse to the longitudinal axis of said housing and being guided in said elongated slots; a centrally located prestressed coil spring in said housing; and a slider actuatable through said coil spring for extending said fins outwardly; the improvement comprising in that said fins radially extend substantially in parallel with said coil spring within said housing in their retracted inoperative position, the free ends of said fins being located in approximately the same plane as the end of the coil spring which contacts a fixed support in said housing; means imparting an axial stroke to said slider for unlatching said fins from their retracted position, said fins at said retained ends being rotatably fixed on the slider, support surface means extending transverse to the longitudinal axis of the projectile for pivoting said fins radially outwardly opposite the direction of flight; an axially movable bearing ring within said housing forming, in conjunction with the retained ends of said fins engaging said support surface means and said slider, a camming arrangement for latching said fins in their radially outwardly extended position.

2. Pivoting guidance mechanism as claimed in claim 1, wherein the fins in the region of their ends towards said support surface means engage a cam roll track which closely contacts a section of a radial and axial cooperating sliding track in said bearing ring with an intermediate bearing point, and wherein the radial pivoting movement of the fins over said bearing point which is located radially below the support axis for the fins extends said fins from their contact against said support surface means to said radial sliding track.

3. Pivoting guidance mechanism as claimed in claim 1, wherein the fins each include a projection at their free ends which, for securing the fins in their retracted position, contacts against a support ring fastened to said housing.

4. Pivoting guidance mechanism as claimed in claim 1, wherein pivotable support means for each of the fins comprises a coiled clamping pin pressed into the fin, a bearing shoulder on the slider contacted by said clamping pin, said clamping pin being secured against radial displacement outwardly through the housing.

5. Pivoting guidance mechanism as claimed in claim 1, wherein the slider includes a plurality of tongues extending in the direction of displacement thereof said tongues being guided in apertures in the bearing ring.

6. Pivoting guidance mechanism as claimed in claim 2, wherein an end of the cam roll track in the extended position of the fins, in cooperation with the bearing point of the bearing ring and the end limit of the elongated slots in the housing determines the extent of the radial outward sweep of the fins.

* * * * *